US011779175B1

(12) United States Patent
Petersen

(10) Patent No.: US 11,779,175 B1
(45) Date of Patent: Oct. 10, 2023

(54) APPARATUS, SYSTEM AND METHOD FOR VACUUM WITH SWITCHABLE COLLECTION CHAMBER

(71) Applicant: Thomas Chris Petersen, Miami Beach, FL (US)

(72) Inventor: Thomas Chris Petersen, Miami Beach, FL (US)

( * ) Notice: Subject to any disclaimer, the term of this patent is extended or adjusted under 35 U.S.C. 154(b) by 0 days.

(21) Appl. No.: 18/092,229

(22) Filed: Dec. 31, 2022

(51) Int. Cl.

| | |
|---|---|
| ***A47L 7/00*** | (2006.01) |
| ***A47L 9/14*** | (2006.01) |
| ***A47L 11/40*** | (2006.01) |
| ***A47L 9/28*** | (2006.01) |
| ***A47L 9/22*** | (2006.01) |

(52) U.S. Cl.
CPC ..... *A47L 7/0028* (2013.01); *A47L 7/0038* (2013.01); *A47L 9/1409* (2013.01); *A47L 9/22* (2013.01); *A47L 9/2805* (2013.01); *A47L 9/2836* (2013.01); *A47L 11/4019* (2013.01); *A47L 11/4016* (2013.01)

(58) Field of Classification Search
CPC .... A47L 7/0028; A47L 7/0038; A47L 9/1409; A47L 9/22; A47L 9/2805; A47L 9/2836; A47L 11/4019; A47L 11/4016
See application file for complete search history.

(56) References Cited

U.S. PATENT DOCUMENTS

| | | | | |
|---|---|---|---|---|
| 3,605,786 | A * | 9/1971 | Machin, Jr. | A47L 7/0038 55/467 |
| 4,171,208 | A | 10/1979 | Lowder | |
| 6,237,186 | B1 | 5/2001 | Griffiths | |
| 6,453,507 | B1 * | 9/2002 | Gilbert | A47L 7/0028 15/353 |
| 8,782,852 | B1 * | 7/2014 | Henderson | A47L 5/22 15/327.2 |
| 11,304,580 | B2 | 4/2022 | Boury | |
| 2005/0241102 | A1 | 11/2005 | Castrovono | |
| 2015/0074936 | A1 * | 3/2015 | Plato | A47L 9/30 15/347 |

FOREIGN PATENT DOCUMENTS

DE 202004013914 U1 * 9/2005

* cited by examiner

*Primary Examiner* — David Redding
(74) *Attorney, Agent, or Firm* — Pablo Meles

(57) ABSTRACT

A vacuum apparatus can include a vacuum chamber assembly having a motor and blowing port, an inlet port forming a portion of the vacuum chamber assembly, a valve plate having a plurality of switchable valves, an intake chamber arranged and constructed between the vacuum chamber assembly and the valve plate, and a water collection chamber having a divided chamber residing below the valve plate, wherein the plurality of switchable valves is configured to switch from a first portion of the divided chamber to at least a second portion of the divided chamber. In some embodiments, the vacuum apparatus further includes a flapper valve at a bottom portion of the water collection chamber where the flapper valve retains and releases water intermittently, periodically or continuously between the first portion of the divided chamber and at least the second portion of the divided chamber.

19 Claims, 11 Drawing Sheets

100

120

120

100

100

LEFT

100

RIGHT

100
FIG. 8
FRONT
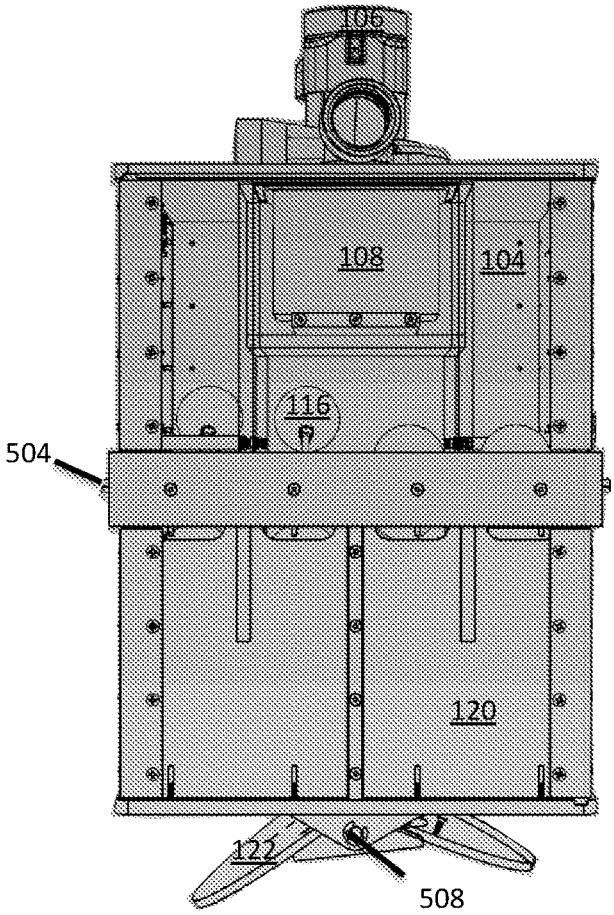
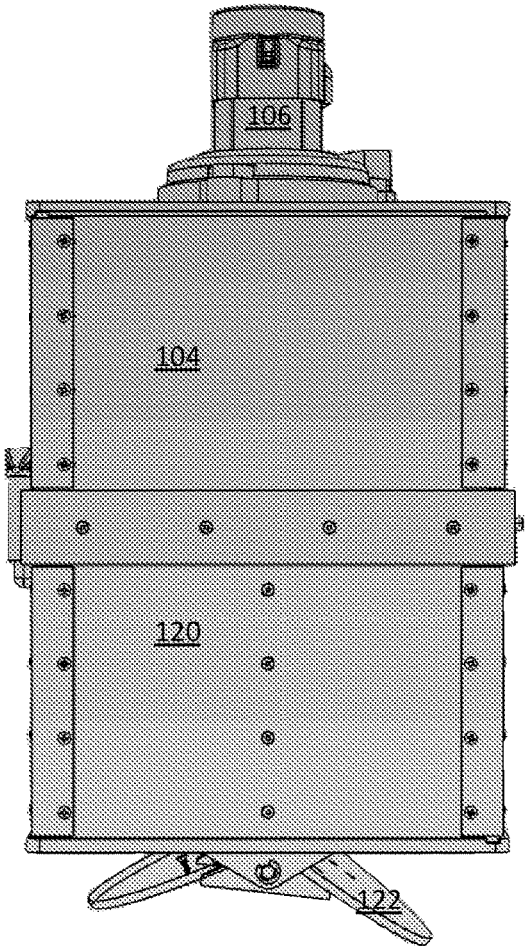
REAR
100
FIG. 9

TOP

100

Bottom

100

100

100

100

1300

APPARATUS, SYSTEM AND METHOD FOR VACUUM WITH SWITCHABLE COLLECTION CHAMBER

CROSS-REFERENCE TO RELATED APPLICATIONS

Not applicable.

TECHNICAL FIELD

The present disclosure generally relates to vacuums. More particularly, but not exclusively, the present disclosure relates to wet/dry vacuum system with switchable collection chambers.

BACKGROUND

Conventional portable wet/dry vacuum systems are typically limited in the amount of water or liquid they can collect at one time before the liquid must be manually released from a water collection chamber. The removal of liquid will typically involve the detachment of the water collection chamber from an overall vacuum assembly or vacuum motor assembly. In some instances, a water collection chamber may have an outlet port for the slow release of water via an outlet hose that must be placed near a drain such as a shower or water tub drain, particularly when working in a multistory building such as a condominium or office building. Otherwise water will likely be released in locations that may not be intended.

In other instances contexts where a dehumidifier has a water collection chamber, the water collection chamber could include a pump to usher out the water collected in the water collection chamber of the dehumidifier. Again, a hose is typically connected to an outlet from the water collection chamber and the hose must be placed near a drain of a shower or tub to avoid having water released in locations unintended. In some instances, more than one pump is used to pump out water from the water collection chamber which can cause further issues such as triggering circuit breakers to switch off when a circuit is overloaded due to the use of multiple pumps and other electronic loads such as the motor of the vacuum itself.

All of the subject matter discussed in the Background section is not necessarily prior art and should not be assumed to be prior art merely as a result of its discussion in the Background section. Along these lines, any recognition of problems in the prior art discussed in the Background section or associated with such subject matter should not be treated as prior art unless expressly stated to be prior art. Instead, the discussion of any subject matter in the Background section should be treated as part of the inventor's approach to the particular problem, which, in and of itself, may also be inventive.

SUMMARY

In some embodiments, a vacuum apparatus includes a vacuum chamber assembly having a motor and blowing port, an inlet port forming a portion of the vacuum chamber assembly, a valve plate having a plurality of switchable valves, an intake chamber arranged and constructed between the vacuum chamber assembly and the valve plate, and a water collection chamber having a divided chamber residing below the valve plate, wherein the plurality of switchable valves is configured to switch from a first portion of the divided chamber to a second portion of the divided chamber.

In some embodiments, the water collection chamber further includes a flapper valve at a bottom portion of the water collection chamber.

In some embodiments, the vacuum apparatus further includes a filter basket configured and constructed between the vacuum chamber assembly and the intake chamber.

In some embodiments, the intake chamber further includes at least one fan guard for mitigating water from entering the motor.

In some embodiments, the vacuum apparatus further includes a latch for coupling the water collection chamber to the vacuum chamber assembly and retaining the intake chamber and the valve plate between the vacuum chamber assembly and the water collection chamber.

In some embodiments, the divided chamber further include at least one or more chamber dividers that further divides the divided chamber into different chamber portions.

In some embodiments, the water collection chamber further includes at least one or more chamber divider having a plurality of holes that further divides the first portion and the second portion of the divided chamber into different portions and allows water to traverse between portions within the first portion and also to traverse between portions within the second portion of the divided chamber.

In some embodiments, the vacuum apparatus further includes at least one actuator that switches the valves on the valve plate from the first chamber to the second chamber.

In some embodiments, the vacuum apparatus further includes at least one water level sensor and at least one actuator that switches the valves on the valve plate from the first chamber to the second chamber upon detection of a predetermined water level.

In some embodiments, the vacuum apparatus further includes at least one actuator coupled to a flapper valve at a bottom portion of the water collection chamber configured to release water within the first portion of the divided chamber of the water collection chamber while closing the second portion of the divided chamber and vice-versa.

In some embodiments, the valve plate includes a plate with a plurality of apertures that open and close using balls on opposing sides of respective rods that rotate about a central axis perpendicular to the respective rods.

In some embodiments, the valve plate includes a plate with a plurality of apertures that open and close using valves formed by balls on opposing sides of respective rods that rotate about a central axis perpendicular to the respective rods and where the valves open air and water flow through the first portion of the divided chamber of the water collection chamber while closing air and water flow through the second portion of the divided chamber of the water collection chamber.

In some embodiments, the vacuum apparatus further includes a flapper valve at a bottom portion of the water collection chamber, where the flapper valve retains and releases water between the first portion of the divided chamber and the second portion of the divided chamber obviating a need to manually empty the water collection chamber.

In some embodiments, a vacuum apparatus can include a vacuum chamber assembly having a motor and blowing port, an inlet port forming a portion of the vacuum chamber assembly, a plurality of switchable valves, an intake chamber arranged and constructed between the vacuum chamber assembly and the plurality of switchable valves, and a water collection chamber having a divided chamber residing below the plurality of switchable valves, wherein the plurality of switchable valves is configured to switch from a first portion of the divided chamber to at least a second portion of the divided chamber. In some embodiments, the vacuum apparatus further includes a flapper valve at a bottom portion of the water collection chamber where the flapper valve retains and releases water intermittently, periodically or continuously between the first portion of the divided chamber and at least the second portion of the divided chamber.

In some embodiments, the divided chamber further includes at least one or more chamber dividers that further divide the divided chamber into different chamber portions.

In some embodiments, the water collection chamber further includes at least one or more chamber dividers having a plurality of holes that further divides the first portion and the second portion of the divided chamber into different portions and allows water to traverse between portions within the first portion and also to traverse between portions within at least the second portion of the divided chamber.

In some embodiments, the vacuum apparatus further includes at least one actuator that switches the valves on a valve plate from the first chamber to at least the second chamber.

In some embodiments, the vacuum apparatus further includes at least one water level sensor and at least one actuator that switches the valves on a valve plate from the first chamber to the second chamber upon detection of a predetermined water level.

In some embodiments, the vacuum apparatus further includes at least one water level sensor and at least one among an actuator that switches the valves on the valve plate from the first chamber to the second chamber upon detection of a predetermined water level or an actuator coupled to a flapper valve at a bottom portion of the water collection chamber configured to intermittently, periodically, or continuously retain and release water within and between the first portion and second portion of the divided chamber of the water collection chamber.

In some embodiments, a method of vacuuming can include creating suction using a vacuum chamber assembly having a motor and blowing port, sucking in at least air and liquid via an inlet port forming a portion of the vacuum chamber assembly, collecting liquid via a water collection chamber having a divided chamber residing below a valve plate, wherein a plurality of switchable valves on the valve plate is configured to switch from a first portion of the divided chamber to at least a second portion of the divided chamber, and intermittently, periodically, or continuously retaining and release water within and between the first portion and second portion of the divided chamber of the water collection chamber using a flapper valve at a bottom portion of the water collection chamber.

BRIEF DESCRIPTION OF THE DRAWINGS

Non-limiting and non-exhaustive embodiments are described with reference to the following drawings, wherein like labels refer to like parts throughout the various views unless otherwise specified. The sizes and relative positions of elements in the drawings are not necessarily drawn to scale. For example, the shapes of various elements are selected, enlarged, and positioned to improve drawing legibility. The particular shapes of the elements as drawn have been selected for ease of recognition in the drawings. One or more embodiments are described hereinafter with reference to the accompanying drawings in which:

FIG. 8 illustrates a partially see-through front side view of the vacuum apparatus of FIG. 1 in accordance with the embodiments.

FIG. 9 illustrates a partially see-through rear view of the vacuum apparatus of FIG. 1 in accordance with the embodiments.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. Also in these instances, well-known structures may be omitted or shown and described in reduced detail to avoid unnecessarily obscuring descriptions of the embodiments.

Figure 1:
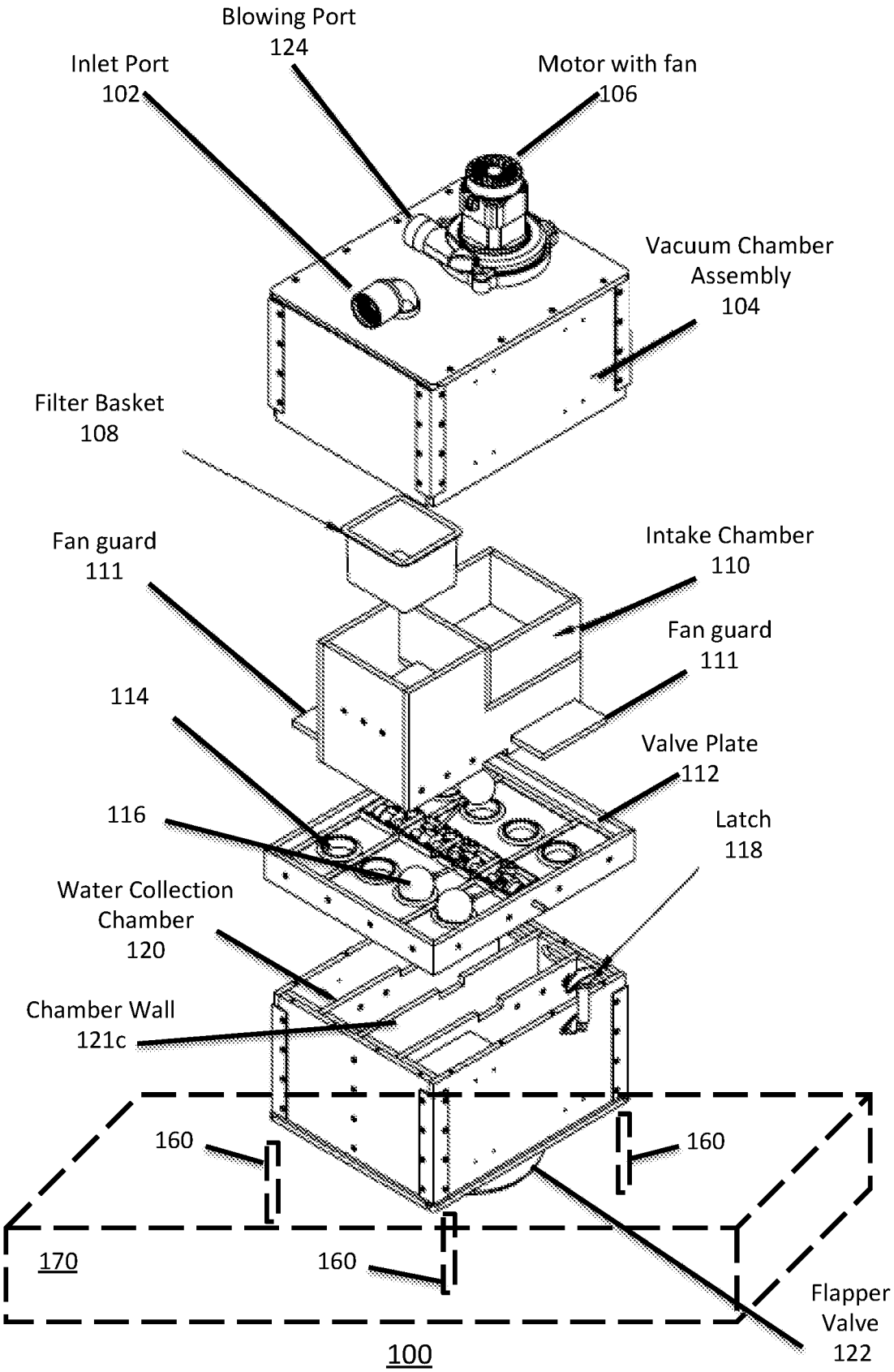
FIG. 1 illustrates an exploded perspective view of a vacuum apparatus or system with switchable collection chambers in accordance with the embodiments.
Figure 2:
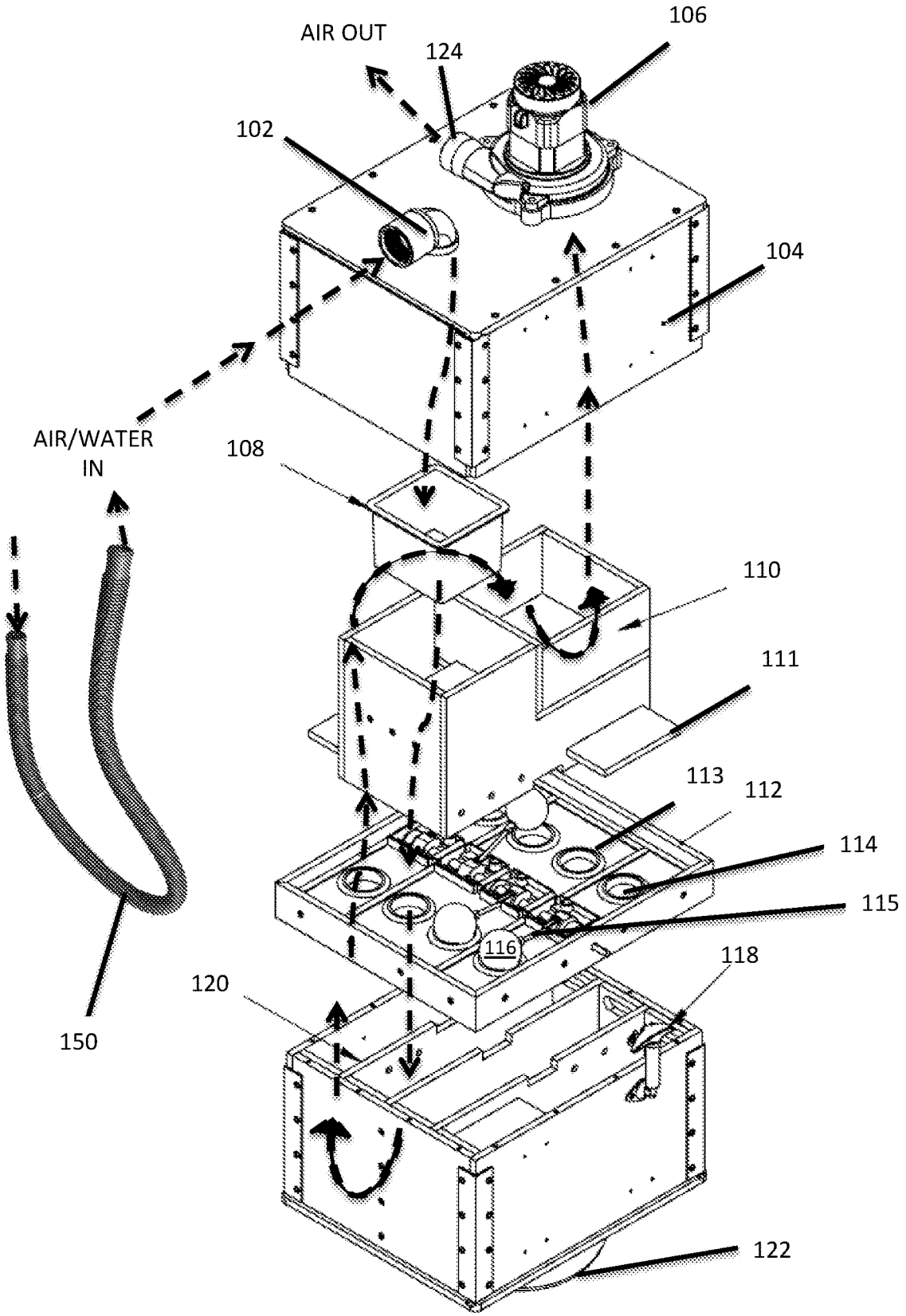
FIG. 2 illustrates the vacuum apparatus of FIG. 1 further illustrating air flow in accordance with the embodiments.

Referring to FIGS. 1-12C, various views of an exemplary vacuum apparatus 100. In particular, FIG. 1 illustrates a exploded perspective view of a vacuum apparatus 100 that includes a vacuum chamber assembly 104 having a motor 106 with fan and blowing port 124, and an inlet port 102 forming a portion of the vacuum chamber assembly 104. A hose 150 (as shown in FIG. 2) can be coupled to the inlet port 102 for picking up water and debris through the inlet port 102. The hose 150 can be of any length as suitably needed for a particular job. For example, in some embodiments, the hose can be 15 feet and in yet other embodiments, it can be 20 feet or another size. The vacuum chamber assembly 104 and a water collection chamber 120 can be configured to enclose a remaining portion of the vacuum apparatus 100. The motor 106 can be of any horsepower, but generally should be configured to have enough power to suck water through a hose of a given length. In some embodiments, the motor 106 can be part of a two-stage vacuum and in yet other embodiments the motor 106 can be part of a three-stage vacuum. In some embodiments, a wand (not shown) can be further attached to the hose 150 and have an end to ideally pickup water and debris from different types of surfaces such as floors having wood, tile, or carpet.

Within the enclosure between the vacuum chamber assembly 104 and water collection chamber 120 can reside a number of elements that would assist in switching the collection of water from one chamber to another including in some embodiments a valve plate 112 having a plurality of switchable valves 116, an intake chamber 110 arranged and constructed between the vacuum chamber assembly 104 and the valve plate 112. As noted above, the vacuum apparatus 100 can include a water collection chamber 120 having a divided chamber residing below the valve plate 112, wherein the plurality of switchable valves (116) is configured to switch from a first portion 121*a* of the divided chamber to a second portion 121*b* of the divided chamber or (lower) water collection chamber 120. Further see FIG. 3. Note that the lower collection chamber can be divided in any number of ways, but in the embodiment shown, an inner chamber wall 121*c* divides the water collection chamber 120 into the first portion 121*a* and the second portion 121*b*. Other embodiments can use other mechanisms for switching the water collection from one chamber to another chamber other than the valve plate and switchable valves shown. For example, flapper valves, sliding valves, or other switching mechanisms (that may or may not use a valve plate as shown) can be used to enable the water collection from one chamber to another within contemplation of the embodiments.

In some embodiments, the water collection chamber 120 further includes a flapper valve 122 at a bottom portion of the water collection chamber 120. In some embodiments, the flapper valve can be configured and constructed to maintain one chamber portion (e.g., 121*a*) closed while it collects a predetermined amount of water in such chamber and then automatically open due to gravity of the water and water flow coming into the chamber portion 121*a*. In some embodiments, the flapper valve 122 can be spring loaded with a predetermined amount of tension. In some embodiments with further reference to FIG. 5, the flapper valve can be configured with an actuator 508 that rotates a rod coupled to the flapper valve 122 to prompt the flapper valve to open and close. In some embodiments, the actuator 508 could work in conjunction with a fluid or water level sensor 510 so that when a certain level of liquid is detected within the chamber portion (e.g., 121*a*), the sensor 510 sends a signal to the actuator 508 to release the valve for one chamber portion (e.g., 121*a*) and simultaneously close the valve for the other chamber portion (e.g., 121*b*). A water level sensor 510 can reside within each chamber portion if desired.

In some embodiments, the vacuum apparatus 100 further includes a filter basket 108 configured and constructed between the vacuum chamber assembly 104 and the intake chamber 110. The filter basket 108 is used to filter out solid debris that may be sucked in with the air and water through the inlet port 102. Alternatively, instead of a filter basket as shown, a cloth-based or mesh-based filter can be used to filter out the solid debris within contemplation of the embodiments. The filter basket 108 can be porous and yet have a fine enough mesh or grid to capture most solid debris. In some embodiments, both a filter basket and a separate cloth or mesh-based filter can be used. In any instance, any or all of the filter basket or cloth or mesh-based filter can be disposable and/or removable.

In some embodiments, the intake chamber 110 further includes at least one or more fan guards 111 for mitigating water or other debris from entering the motor. The fan guard 111 appears as an extended shelf perpendicular to the intake chamber 110 and serves to prevent water or other matter from being sucked up into the motor 106 or associated fan.

In some embodiments, the vacuum apparatus 100 further includes a latch 118 for coupling the water collection chamber 120 to the vacuum chamber assembly 104 and retaining the intake chamber 110 and the valve plate 112 between the vacuum chamber assembly 104 and the water collection chamber 120. This configurations can provide a simple assembly and disassembly of the vacuum apparatus 100.

Figure 3:
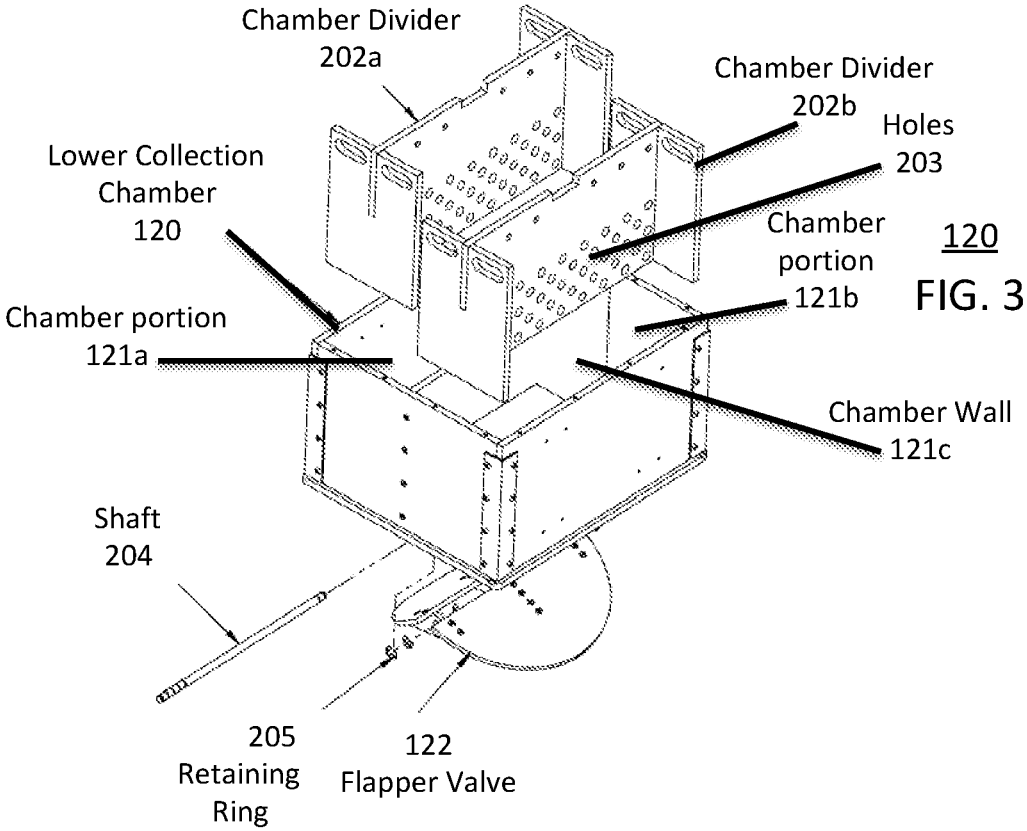
FIG. 3 illustrates an exploded perspective view of the lower collection chamber of the apparatus of FIG. 1, in accordance with the embodiments.
Figure 4:
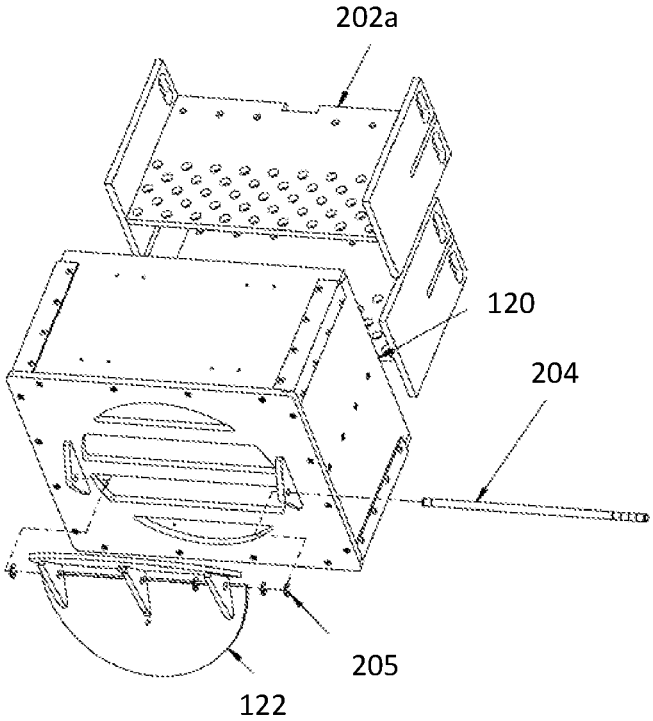
FIG. 4 illustrates another exploded perspective view of the lower collection chamber of FIG. 1, in accordance with the embodiments.

In some embodiments, the divided chamber further include at least one or more chamber dividers that further divides the divided chamber (120) into different chamber portions. The chamber dividers can take the form of an internal chamber wall 121*c* that essentially dives the water collection chamber 120 into two portions or two halves or sub-chambers. The sub-chambers themselves can further be divided using inserts or the chamber dividers 202*a* and 202*b* as shown in FIG. 3.

In some embodiments, the water collection chamber 120 further includes the one or more chamber dividers (202*a* or 202*b*) further having a plurality of holes 203 where the chamber dividers further divide the first portion and the second portion of the divided chamber (e.g., the sub-chambers noted above) into yet different portions and also allows water to traverse between portions within the first portion and also allows water to traverse between portions within the second portion of the divided chamber. The holes in the chamber dividers generally serve to baffle or mitigate water from reaching the motor or motor chamber.

Figure 5:
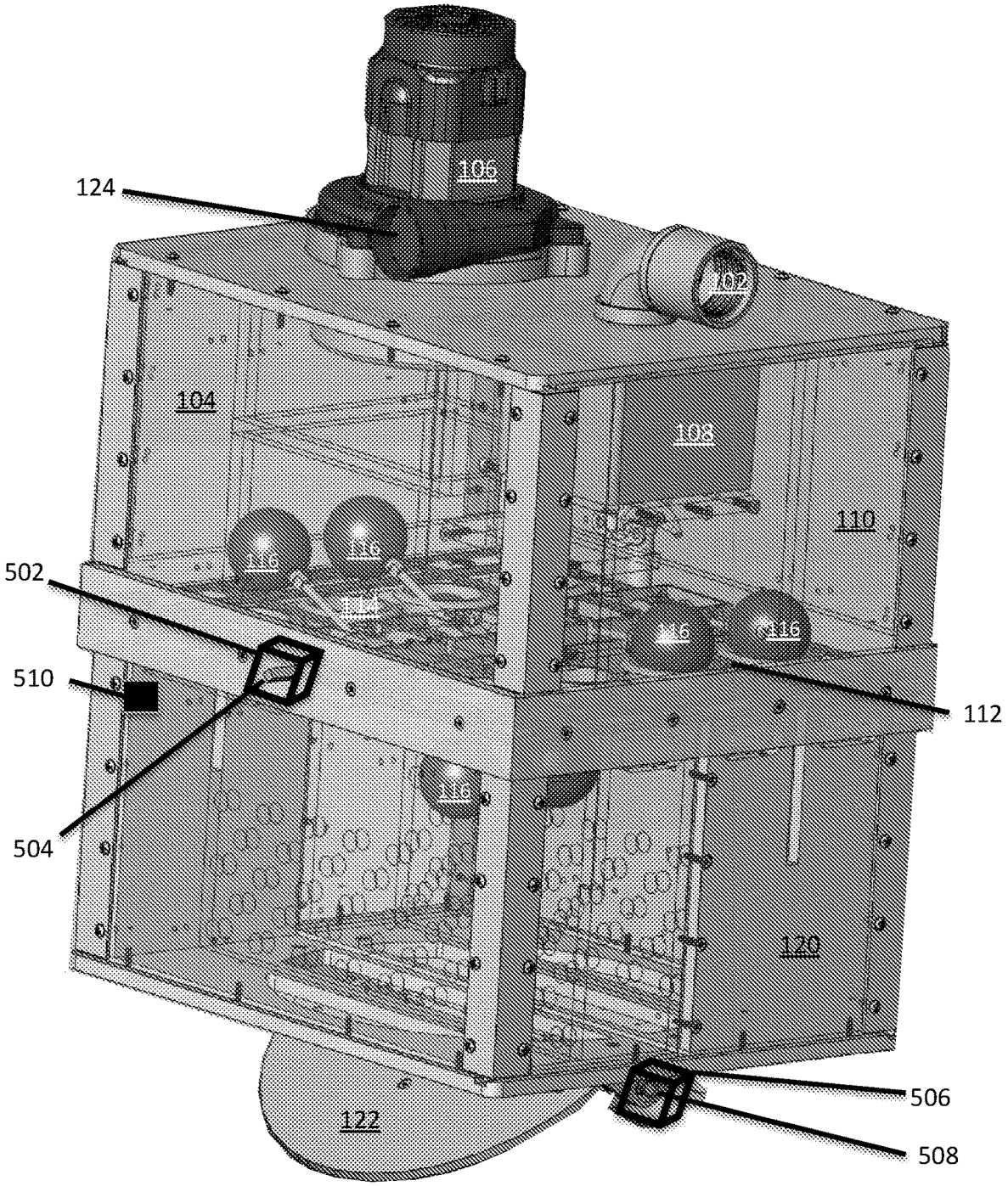
FIG. 5 illustrates a partially see-through perspective view of the vacuum apparatus of FIG. 1 in accordance with the embodiments.
Figure 6:
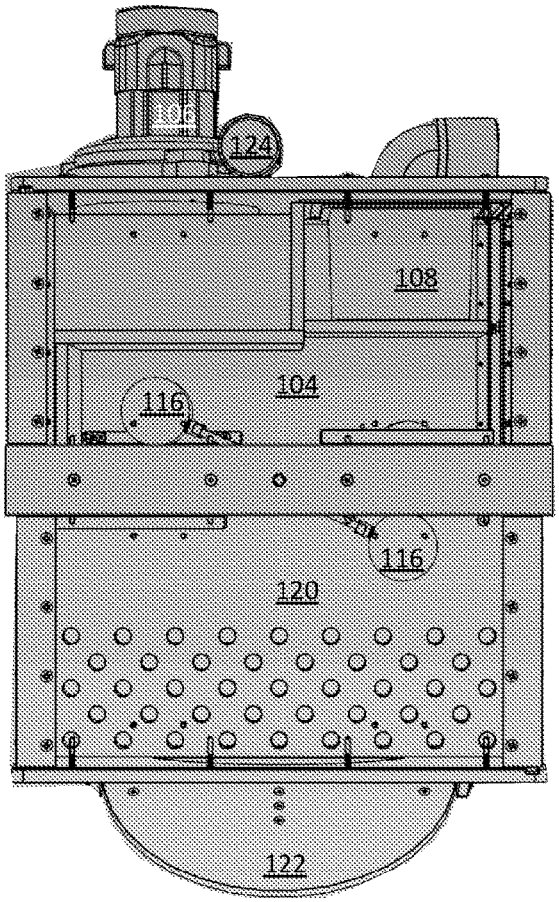
FIG. 6 illustrates a partially see-through left side view of the vacuum apparatus of FIG. 1 in accordance with the embodiments.
Figure 7:
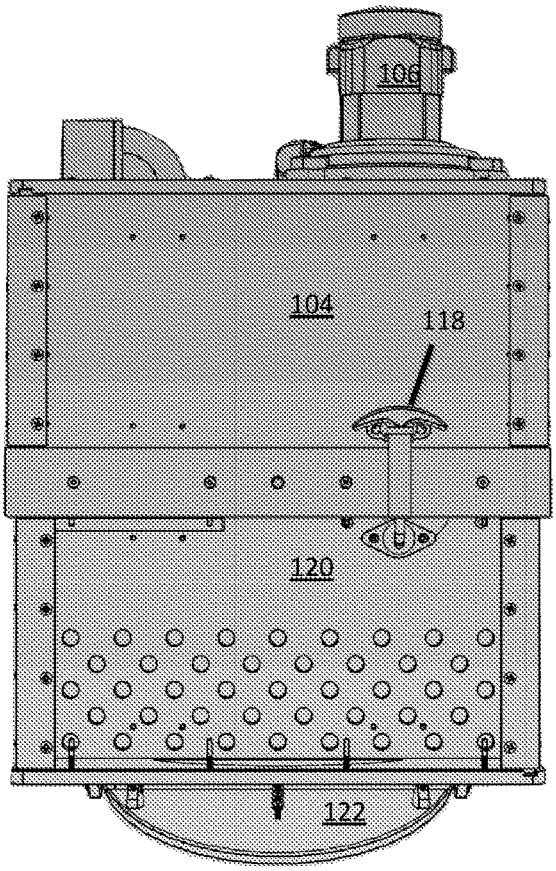
FIG. 7 illustrates a partially see-through right side view of the vacuum apparatus of FIG. 1 in accordance with the embodiments.
Figure 10:
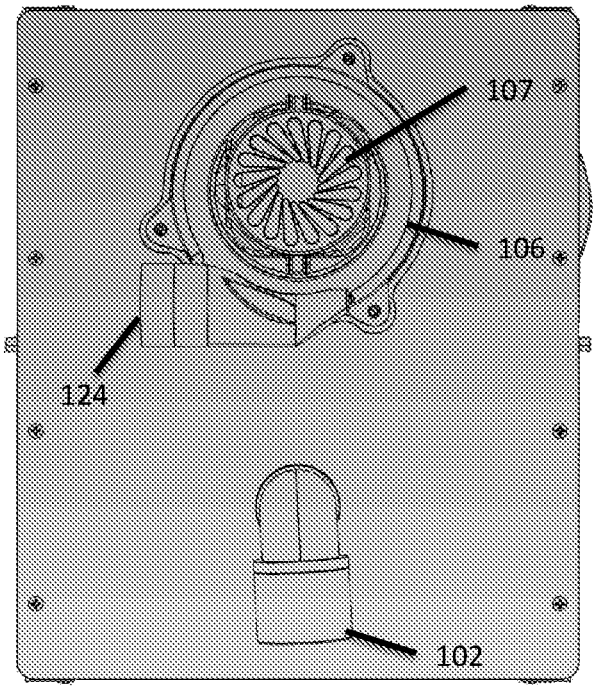
FIG. 10 illustrates a partially see-through top-side view of the vacuum apparatus of FIG. 1 in accordance with the embodiments.
Figure 11:
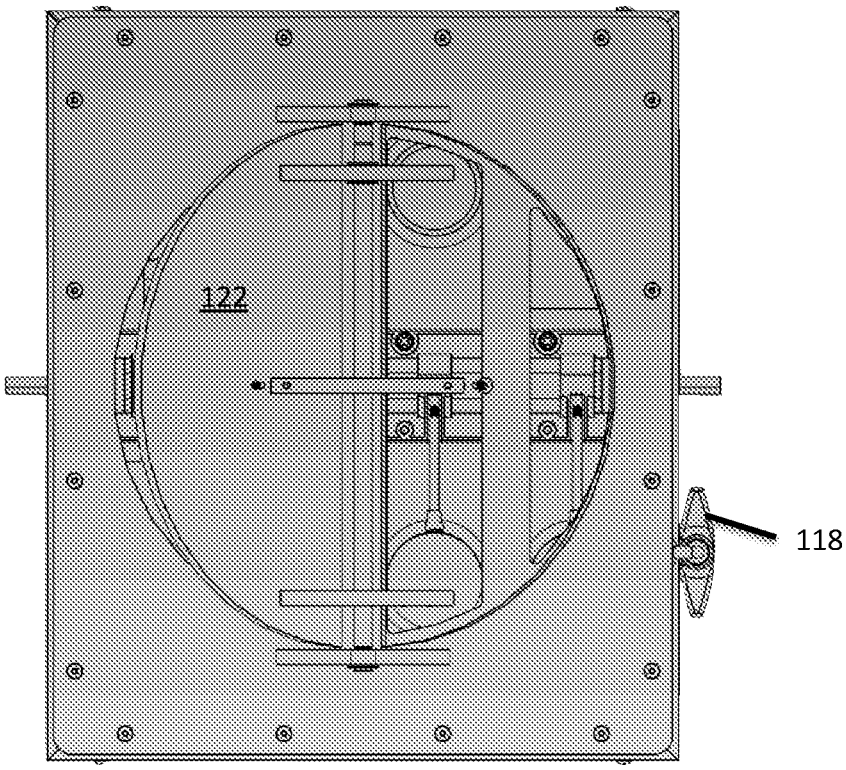
FIG. 11 illustrates a partially see-through bottom-side view of the vacuum apparatus of FIG. 1 in accordance with the embodiments.
Figure 12A:
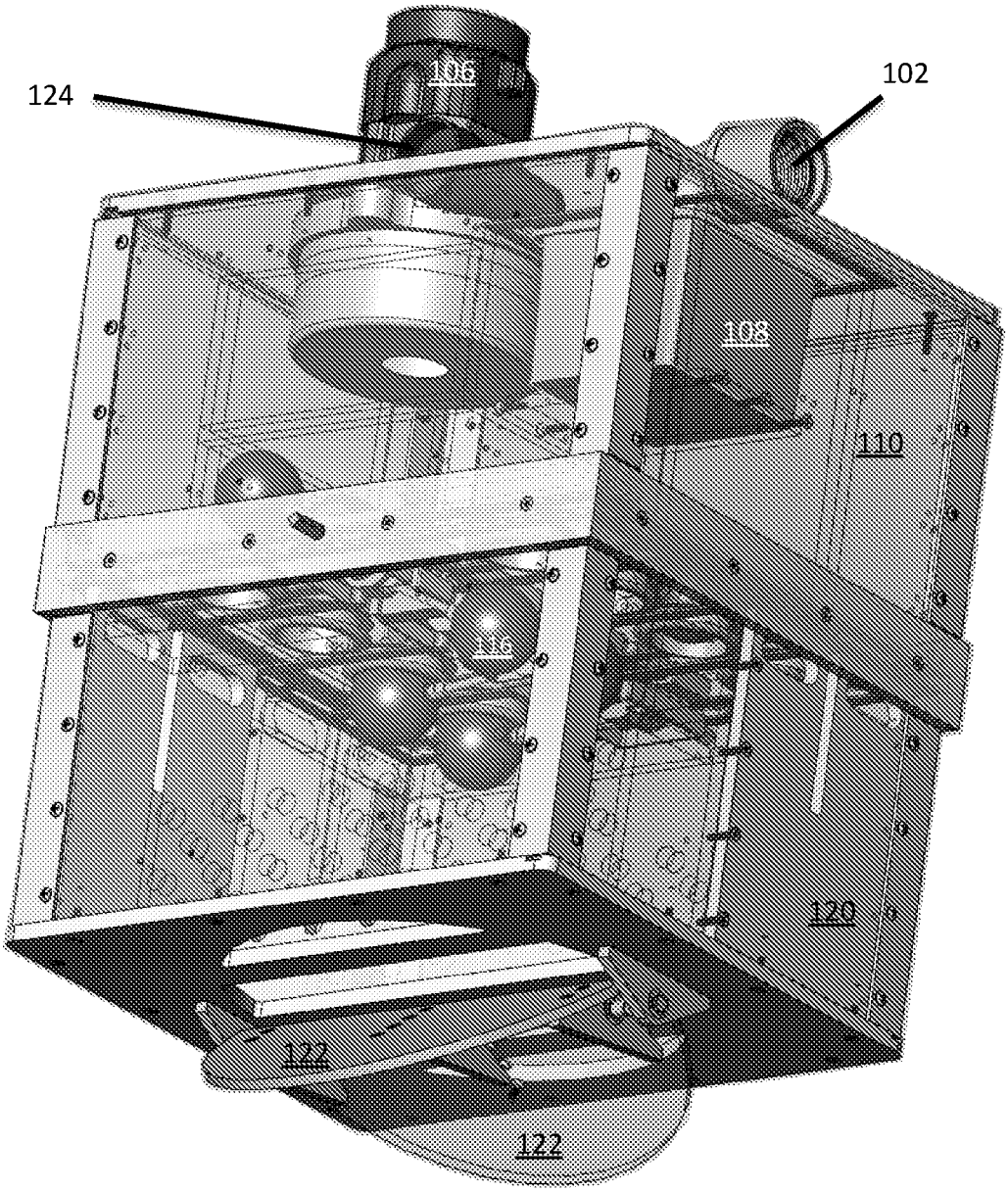
FIG. 12A illustrates a partially see-through perspective view of the vacuum apparatus of FIG. 1 further showing a lower collection chamber portion and motor in accordance with the embodiments.
Figure 12B:
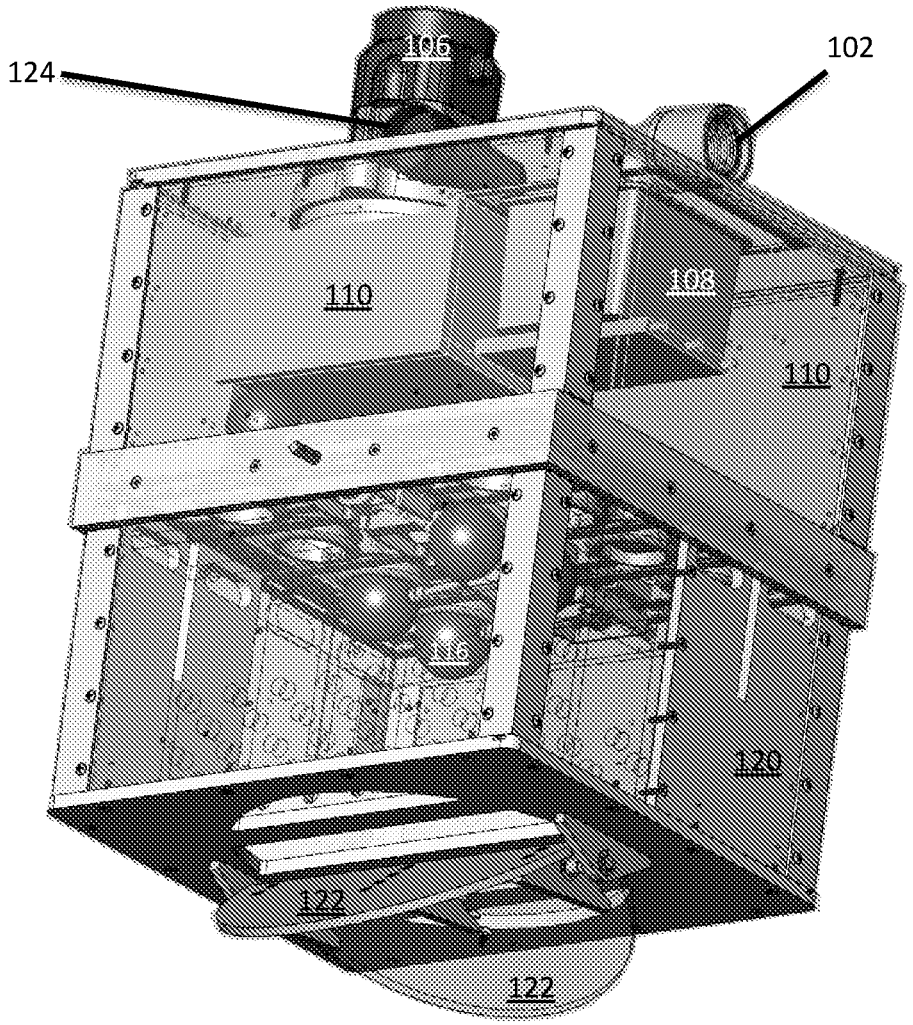
FIG. 12B illustrates a partially see-through perspective view of the vacuum apparatus of FIG. 1 further showing an intake chamber in accordance with the embodiments.
Figure 12C:
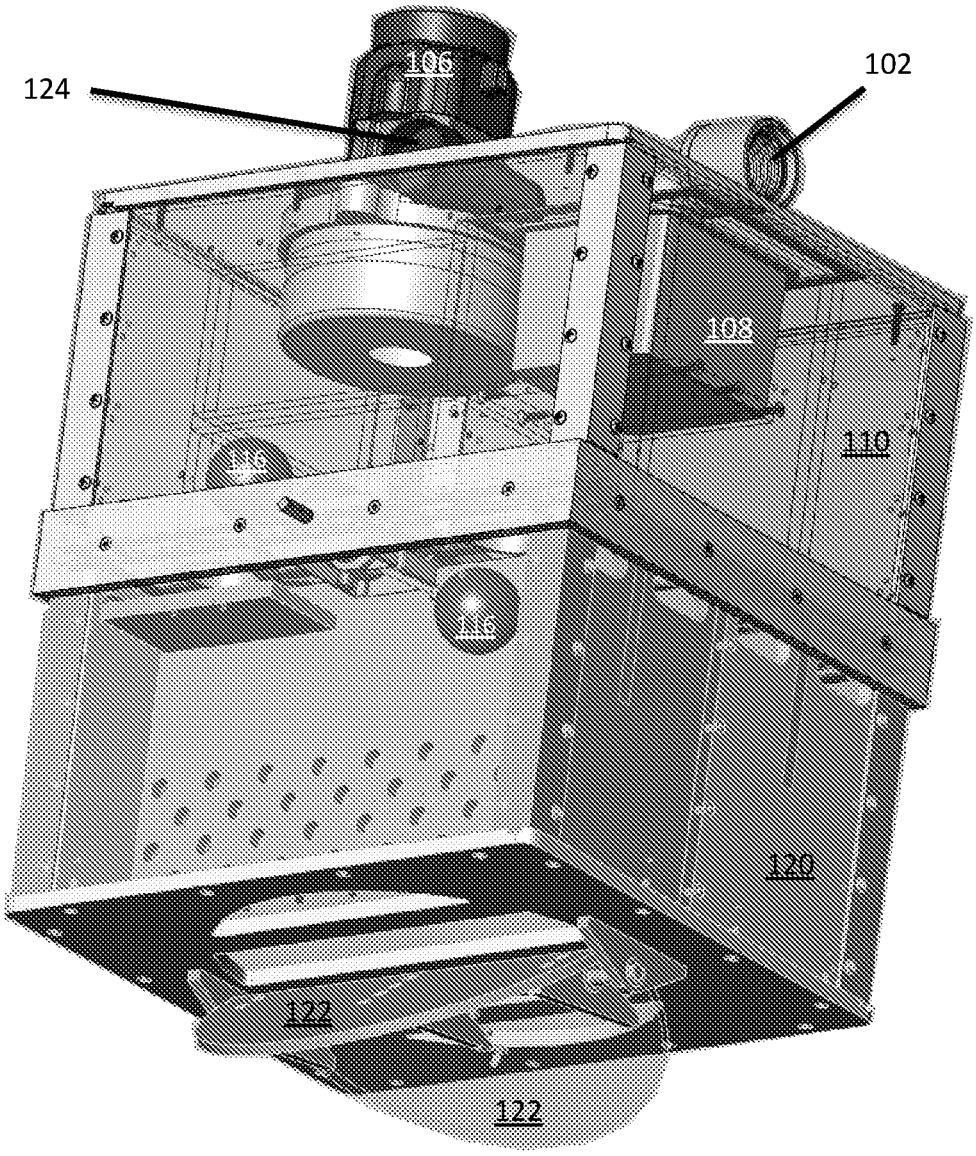
FIG. 12C illustrates a partially see-through perspective view of the vacuum apparatus of FIG. 1 further showing a divided portion of a collection chamber portion in accordance with the embodiments.

In some embodiments with further reference to FIG. 5, the vacuum apparatus 100 further includes at least one actuator 502 that switches the valves 116 on the valve plate 112 from the first chamber 121*a* to the second chamber 121*b* or vice-versa. The actuator 502 can be coupled to a rod 504 or other link that drives the valves 116 to switch from one position to another causing one chamber to have air flow and the other to have not.

In some embodiments with reference again to FIG. 5, the vacuum apparatus 100 further includes at least one water level sensor 510 and at least one actuator 502 that switches the valves 116 on the valve plate 112 from the first chamber 121*a* to the second chamber 121*b* upon detection of a predetermined water level.

In some embodiments with reference again to FIG. 5, the vacuum apparatus further includes at least one actuator 506 coupled to a flapper valve 122 at a bottom portion of the water collection chamber 120 configured to release water within the first portion (121*a*) of the divided chamber of the water collection chamber 120 while closing the second portion (121*b*) of the divided chamber and vice-versa. The actuator 506 can also be coupled to a rod 508 or link that drives the flapper valve 122 to switch from one position to another causing the one chamber to release water while enabling the other chamber to retain and accumulate water.

In some embodiments, the vacuum apparatus 100 can have both the actuator 502 for actuating the valves 116 and the actuator 506 for actuating the flapper valve 122. The actuators 502 and 506 can be coordinated to operate in tandem and to further operate in coordination with the water level sensor 510. In some embodiments, the vacuum apparatus 100 can operate without necessarily using a water level sensor (510) and can instead rely on predetermined water pressure or weight.

Operationally and with reference to FIG. 2, the vacuum apparatus 100 would likely have a first chamber portion (121*a*) with open valves 116 allowing air and water through the apertures or holes 114 of the valve plate 112 and also concurrently have the flapper valve 122 closed for the first chamber portion so that water is collected in the first chamber portion (121*a*) of the water collection chamber 120 while air is being driven back up from the water collection chamber 120 through the holes 114 and through the intake chamber and out of the blowing port 124. Once the water reaches a certain level (either by detection of the sensor 510 and further activation of the actuator 506) or by mere weight or water pressure force being exerted downward on the flapper valve 122, the flapper valve 122 switches and releases the collected water in the first chamber (121*a*) while concurrently closing the second chamber portion (121*b*) and allowing water to accumulate in the second chamber portion. Concurrently, the valves 116 for the first chamber can be closed and the valves 116 for the second chamber can be opened on the valve plate 112. The actuator 504 can cause this simultaneous opening and closing of the various valves 116. In other embodiments, the valves 116 can be buoyant and be driven up and down by the water level within the respect chamber portions.

In some embodiments and with further reference to FIG. 2, the valve plate 112 includes a plate with a plurality of apertures 114 that open and close using balls (116) on opposing sides of respective rods 115 that rotate about a central axis perpendicular to the respective rods. In some embodiments, the apertures 114 can further include a gasket or seal on the periphery of the apertures so that the valves (or balls 116) provide a better seal.

In some embodiments, the valve plate 112 includes a plate with a plurality of apertures 114 that open and close using valves formed by balls (116) on opposing sides of respective rods 115 that rotate about a central axis perpendicular to the respective rods 115 and where the valves open air and water flow through the first portion (121*a*) of the divided chamber of the water collection chamber while closing air and water flow through the second portion (121*b*) of the divided chamber of the water collection chamber 120.

In some embodiments, the vacuum apparatus 100 further includes a flapper valve 122 at a bottom portion of the water collection chamber 120, where the flapper valve 122 retains and releases water between the first portion 121*a* of the divided chamber (120) and the second portion 121*b* of the divided chamber obviating a need to manually empty the water collection chamber. In the context of using such a vacuum apparatus 100 in an apartment building, condominium, or office building, the vacuum can simply be placed on top of a toilet allowing water to come out via the flapper valve and into the toilet bowl. Alternatively, the vacuum apparatus 100 can be placed in a tub or shower area with a drain and slightly raised above the ground with feet or legs 160 as shown in FIG. 1 to allow the flapper valve to operate as intended. In any case, the vacuum apparatus 100 conveniently provides for operation without the need for a separate hose to release collected water and also provides for intermittent, periodic or continuous release of collected water without having to disassemble the vacuum apparatus 100 in any manner. In some embodiments, the vacuum apparatus can optionally further utilize an external bucket, tub, or collection or retention area 170 for collecting water in a larger volume than that provided by the vacuum apparatus. The tub 170 can be used to temporarily collect a larger volume of water exiting the flapper valve, particularly if no drain, toilet or other means of disposal is readily available.

In some embodiments with reference to FIGS. 1-5, a vacuum apparatus 100 can include a vacuum chamber assembly 104 having a motor 106 and blowing port 124, an inlet port 102 forming a portion of the vacuum chamber assembly, a valve plate 112 having a plurality of switchable valves 116, an intake chamber 110 arranged and constructed between the vacuum chamber assembly 104 and the valve plate 112, and a water collection chamber 120 having a divided chamber residing below the valve plate 112 with an internal chamber wall or divider wall 121*c*, where the plurality of switchable valves 116 is configured to switch from a first portion (121*a*) of the divided chamber to at least a second portion (121*b*) of the divided chamber (120). In some embodiments, the vacuum apparatus 100 further includes a flapper valve 122 at a bottom portion of the water collection chamber 120 where the flapper valve 122 retains and releases water intermittently, periodically or continuously between the first portion of the divided chamber and at least the second portion of the divided chamber.

In some embodiments, the divided chamber further includes at least one or more chamber dividers (202*a* and 202*b*) that further divide the divided chamber (120) into different chamber portions.

In some embodiments, the water collection chamber 120 further includes at least one or more chamber dividers (202*a* and 202*b*) having a plurality of holes 203 that further divides the first portion and the second portion of the divided chamber into different portions and allows water to traverse between portions within the first portion and also to traverse between portions within at least the second portion of the divided chamber.

In some embodiments, the vacuum apparatus 100 further includes at least one water level sensor 510 and at least one among an actuator 502 that switches the valves 116 on the valve plate 112 from the first chamber to the second chamber upon detection of a predetermined water level or an actuator 506 coupled to a flapper valve 122 at a bottom portion of the water collection chamber 120 configured to intermittently, periodically, or continuously retain and release water between the first portion and second portion of the divided chamber of the water collection chamber. In some embodiments, the vacuum apparatus 100 can include both actuators 502 and 506 that can operate in coordination to enable the filling and evacuation of one chamber portion or another in an automatic manner that does not require manual intervention to eliminate water from the water collection chamber.

Figure 13:
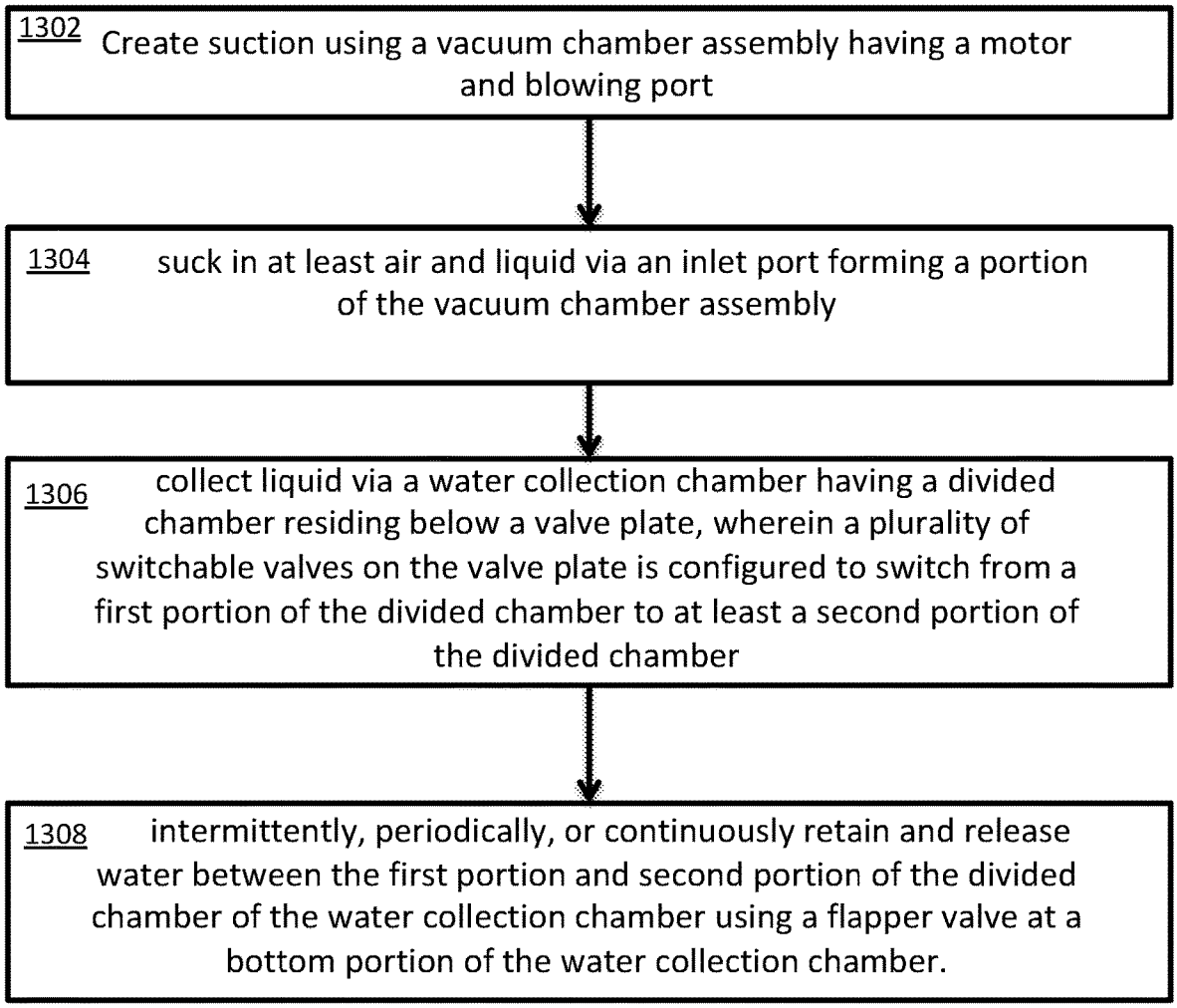
FIG. 13 is a flow chart illustrating a method of vacuuming in accordance with the embodiments.

In some embodiments as further illustrated by the flow chart of FIG. 13 and the preceding FIGS. 1-12C, a method 1300 of vacuuming can include creating at step 1302 suction using a vacuum chamber assembly having a motor and blowing port, sucking in at step 1304 at least air and liquid via an inlet port forming a portion of the vacuum chamber assembly, collecting liquid at step 1306 via a water collection chamber having a divided chamber residing below a valve plate, wherein a plurality of switchable valves on the valve plate is configured to switch from a first portion of the divided chamber to at least a second portion of the divided chamber, and at step 1308, intermittently, periodically, or continuously retaining and release water between at least the first portion and second portion of the divided chamber of the water collection chamber using a flapper valve at a bottom portion of the water collection chamber.

In the absence of any specific clarification related to its express use in a particular context, where the terms "substantial" or "about" in any grammatical form are used as modifiers in the present disclosure and any appended claims (e.g., to modify a structure, a dimension, a measurement, or some other characteristic), it is understood that the characteristic may vary by up to 30 percent. For example, a small cell networking device may be described as being mounted "substantially vertical," In these cases, a device that is mounted exactly vertical is mounted along a "Y" axis and a "X" axis that is normal (i.e., 90 degrees or at right angle) to a plane or line formed by a "Z" axis. Different from the exact precision of the term, "vertical," and the use of "substantially" or "about" to modify the characteristic permits a variance of the particular characteristic by up to 30 percent.

The terms "include" and "comprise" as well as derivatives thereof, in all of their syntactic contexts, are to be construed without limitation in an open, inclusive sense, (e.g., "including, but not limited to"). The term "or," is inclusive, meaning and/or. The phrases "associated with" and "associated therewith," as well as derivatives thereof, can be understood as meaning to include, be included within, interconnect with, contain, be contained within, connect to or with, couple to or with, be communicable with, cooperate with, interleave, juxtapose, be proximate to, be bound to or with, have, have a property of, or the like.

Unless the context requires otherwise, throughout the specification and claims which follow, the word "comprise" and variations thereof, such as, "comprises" and "comprising," are to be construed in an open, inclusive sense, e.g., "including, but not limited to."

Reference throughout this specification to "one embodiment" or "an embodiment" or "some embodiments" and variations thereof mean that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content and context clearly dictates otherwise. It should also be noted that the conjunctive terms, "and" and "or" are generally employed in the broadest sense to include "and/or" unless the content and context clearly dictates inclusivity or exclusivity as the case may be. In addition, the composition of "and" and "or" when recited herein as "and/or" is intended to encompass an embodiment that includes all of the associated items or ideas and one or more other alternative embodiments that include fewer than all of the associated items or idea.

In the present disclosure, conjunctive lists make use of a comma, which may be known as an Oxford comma, a Harvard comma, a serial comma, or another like term. Such lists are intended to connect words, clauses or sentences such that the thing following the comma is also included in the list.

As the context may require in this disclosure, except as the context may dictate otherwise, the singular shall mean the plural and vice versa. All pronouns shall mean and include the person, entity, firm or corporation to which they relate. Also, the masculine shall mean the feminine and vice versa.

When so arranged as described herein, each computing device may be transformed from a generic and unspecific computing device to a combination device comprising hardware and software configured for a specific and particular purpose. When so arranged as described herein, to the extent that any of the inventive concepts described herein are found by a body of competent adjudication to be subsumed in an abstract idea, the ordered combination of elements and limitations are expressly presented to provide a requisite inventive concept by transforming the abstract idea into a tangible and concrete practical application of that abstract idea.

The headings and Abstract of the Disclosure provided herein are for convenience only and do not limit or interpret the scope or meaning of the embodiments. The various embodiments described above can be combined to provide further embodiments. Aspects of the embodiments can be modified, if necessary to employ concepts of the various patents, application and publications to provide further embodiments.

The invention claimed is:

1. A vacuum apparatus, comprising:

a vacuum chamber assembly having a motor and blowing port;

an inlet port forming a portion of the vacuum chamber assembly;

a valve plate having a plurality of switchable valves;

an intake chamber arranged and constructed between the vacuum chamber assembly and the valve plate; and a water collection chamber having a divided chamber residing below the valve plate, wherein the plurality of switchable valves is configured to switch from a first portion of the divided chamber to a second portion of the divided chamber.

2. The vacuum apparatus of claim 1, wherein the water collection chamber further comprises a flapper valve at a bottom portion of the water collection chamber.

3. The vacuum apparatus of claim 1, further comprising a filter basket configured and constructed between the vacuum chamber assembly and the intake chamber.

4. The vacuum apparatus of claim 1, wherein the intake chamber further comprises at least one fan guard for mitigating water from entering the motor.

5. The vacuum apparatus of claim 1, further comprising a latch for coupling the water collection chamber to the vacuum chamber assembly and retaining the intake chamber and the valve plate between the vacuum chamber assembly and the water collection chamber.

6. The vacuum apparatus of claim 1, wherein the divided chamber further comprises at least one or more chamber dividers that further divides the divided chamber into different chamber portions.

7. The vacuum apparatus of claim 1, wherein the water collection chamber further comprises at least one or more chamber divider having a plurality of holes that further divides the first portion and the second portion of the divided chamber into different portions and allows water to traverse between portions within the first portion and also to traverse between portions within the second portion of the divided chamber.

8. The vacuum apparatus of claim 1, wherein the vacuum apparatus further comprises at least one actuator that switches the valves on the valve plate from the first chamber to the second chamber.

9. The vacuum apparatus of claim 1, wherein the vacuum apparatus further comprises at least one water level sensor and at least one actuator that switches the valves on the valve plate from the first chamber to the second chamber upon detection of a predetermined water level.

10. The vacuum apparatus of claim 1, wherein the vacuum apparatus further comprises at least one actuator coupled to a flapper valve at a bottom portion of the water collection chamber configured to release water within the first portion of the divided chamber of the water collection chamber while closing the second portion of the divided chamber and vice-versa.

11. The vacuum apparatus of claim 1, wherein the valve plate comprises a plate with a plurality of apertures that open and close using balls on opposing sides of respective rods that rotate about a central axis perpendicular to the respective rods.

12. The vacuum apparatus of claim 1, wherein the valve plate comprises a plate with a plurality of apertures that open and close using valves formed by balls on opposing sides of respective rods that rotate about a central axis perpendicular to the respective rods and wherein the valves open air and water flow through the first portion of the divided chamber of the water collection chamber while closing air and water flow through the second portion of the divided chamber of the water collection chamber.

13. The vacuum apparatus of claim 1, further comprising a flapper valve at a bottom portion of the water collection chamber, wherein the flapper valve retains and releases water between the first portion of the divided chamber and the second portion of the divided chamber obviating a need to manually empty the water collection chamber.

14. A vacuum apparatus, comprising:

a vacuum chamber assembly having a motor and blowing port;

an inlet port forming a portion of the vacuum chamber assembly;

a plurality of switchable valves;

an intake chamber arranged and constructed between the vacuum chamber assembly and the plurality of switchable valves;

a water collection chamber having a divided chamber residing below the plurality of switchable valves, wherein the plurality of switchable valves is configured to switch from a first portion of the divided chamber to at least a second portion of the divided chamber; and a flapper valve at a bottom portion of the water collection chamber, wherein the flapper valve retains and releases water intermittently, periodically, or continuously between the first portion of the divided chamber and at least the second portion of the divided chamber.

15. The vacuum apparatus of claim 14, wherein the divided chamber further comprises at least one or more chamber dividers that further divide the divided chamber into different chamber portions.

16. The vacuum apparatus of claim 1, wherein the water collection chamber further comprises at least one or more chamber dividers having a plurality of holes that further divides the first portion and the second portion of the divided chamber into different portions and allows water to traverse between portions within the first portion and also to traverse between portions within at least the second portion of the divided chamber.

17. The vacuum apparatus of claim 1, wherein the vacuum apparatus further comprises at least one actuator that switches the plurality of switchable valves on a valve plate from the first chamber to at least the second chamber.

18. The vacuum apparatus of claim 1, wherein the vacuum apparatus further comprises at least one water level sensor and at least one actuator that switches the plurality of switchable valves from the first chamber to the second chamber upon detection of a predetermined water level.

19. The vacuum apparatus of claim 1, wherein the vacuum apparatus further comprises at least one water level sensor and at least one among an actuator that switches the plurality of switchable valves on a valve plate from the first chamber to the second chamber upon detection of a predetermined water level or an actuator coupled to a flapper valve at a bottom portion of the water collection chamber configured to intermittently, periodically, or continuously retain and release water between the first portion and second portion of the divided chamber of the water collection chamber.

* * * * *